US009735474B2

(12) United States Patent
Shmuel

(10) Patent No.: US 9,735,474 B2
(45) Date of Patent: Aug. 15, 2017

(54) DEPLOYABLE ANTENNA ARRAY AND METHOD FOR DEPLOYING ANTENNA ARRAY

(75) Inventor: Amir Shmuel, Ashdod (IL)

(73) Assignee: ELTA SYSTEMS LTD., Ashdod (IL)

( * ) Notice: Subject to any disclaimer, the term of this patent is extended or adjusted under 35 U.S.C. 154(b) by 233 days.

(21) Appl. No.: 13/810,517

(22) PCT Filed: Jul. 19, 2011

(86) PCT No.: PCT/IL2011/000575

§ 371 (c)(1),
(2), (4) Date: Mar. 18, 2013

(87) PCT Pub. No.: WO2012/011102

PCT Pub. Date: Jan. 26, 2012

(65) Prior Publication Data

US 2013/0169505 A1 Jul. 4, 2013

(30) Foreign Application Priority Data

Jul. 21, 2010 (IL) ..... 207125

(51) Int. Cl.
*H01Q 21/00* (2006.01)
*H01Q 1/08* (2006.01)
(Continued)

(52) U.S. Cl.
CPC ..... *H01Q 21/00* (2013.01); *H01Q 1/088* (2013.01); *H01Q 1/1235* (2013.01); *H01Q 9/285* (2013.01); *H01Q 21/062* (2013.01)

(58) Field of Classification Search
CPC ..... H01Q 21/00
(Continued)

(56) References Cited

U.S. PATENT DOCUMENTS 4,482,900 A 11/1984 Bilek et al.
5,196,857 A 3/1993 Chiappetta et al.
(Continued)

FOREIGN PATENT DOCUMENTS

EP 194749 A2 9/1986
EP 833404 A2 4/1998
(Continued)

OTHER PUBLICATIONS

Huang, et al., "The Development of Inflatable Array Antennas," American Institute of Aeronautics and Astronautics, 2002.
(Continued)

*Primary Examiner* — Dameon E Levi
*Assistant Examiner* — Walter Davis
(74) *Attorney, Agent, or Firm* — Harness, Dickey & Pierce, P.L.C.

(57) ABSTRACT

A deployable antenna array is provided having at least one boresight axis, and including a first plurality of first antenna array elements and a second plurality of second antenna array elements separate from the first plurality of first antenna array elements, the antenna array being configured for being selectively deployable at least from a stowed configuration to a deployed configuration. A radar system including an antenna array, a telecommunication system including an antenna array, and a method for deploying an antenna array are also provided.

39 Claims, 6 Drawing Sheets

(51) Int. Cl.
*H01Q 1/12* (2006.01)
*H01Q 9/28* (2006.01)
*H01Q 21/06* (2006.01)

(58) Field of Classification Search
USPC ..... 343/815, 915, 700 MS, 838, 848
See application file for complete search history.

(56) References Cited

U.S. PATENT DOCUMENTS

| | | | | |
|---|---|---|---|---|
| 5,227,808 | A | 7/1993 | Davis | |
| 5,313,221 | A | 5/1994 | Denton, Jr. | |
| 5,357,259 | A | 10/1994 | Nosal | |
| 5,519,408 | A | 5/1996 | Schnetzer | |
| 5,909,197 | A | 6/1999 | Heinemann et al. | |
| 6,266,030 | B1 | 7/2001 | Warren et al. | |
| 6,906,679 | B2 | 6/2005 | Kneisel et al. | |
| 7,009,578 | B2 * | 3/2006 | Nolan | H01Q 1/08 343/897 |
| 7,176,844 | B2 * | 2/2007 | Chiang | H01Q 1/24 343/815 |
| 7,211,722 | B1 | 5/2007 | Murphy | |
| 7,265,719 | B1 * | 9/2007 | Moosbrugger | H01Q 21/0025 343/700 MS |
| 7,372,423 | B2 | 5/2008 | Packer et al. | |
| 2007/0135171 | A1 | 6/2007 | Hara | |

FOREIGN PATENT DOCUMENTS

| | | | |
|---|---|---|---|
| GB | 2444802 | A | 6/2008 |
| WO | WO-2004/015809 | A2 | 2/2004 |
| WO | WO-2006/130993 | A1 | 12/2006 |
| WO | WO-2008/007143 | A1 | 1/2008 |

OTHER PUBLICATIONS

Fralick et al., "Performance Evaluation of a Membrane Waveguide Array Antenna," IEEE, 2003.

Soykasap et al., "Tape Spring Large Deployable Antenna," American Institute of Aeronautics and Astronautics Paper 2006-1601, 2006.

Chung et al., "Integration of a 4×8 Antenna Array with a Reconfigurable 2-bit Phase Shifter Using RF MEMS Switches on Multilayer Organic Substrates," IEEE, 2007.

Lan et al., "Design of a Deployablde Antenna Actuated by Shape Memory Alloy Hinge," Trans Tech Publications, 2007.

B F Knight, "Deployable Antenna Kinematics Using Tensegrity Structure Design," Thesis, University of Florida, 2000.

International Search Report for PCT/IL11/00575, mailed Nov. 30, 2001; 2 pages.

* cited by examiner

DEPLOYABLE ANTENNA ARRAY AND METHOD FOR DEPLOYING ANTENNA ARRAY

FIELD OF THE INVENTION

This invention relates to deployable antenna systems and methods, in particular array antenna systems that are deployable from a stowed configuration.

BACKGROUND OF THE INVENTION

Stowable and deployable antenna arrays are known and have several uses.

By way of non-limiting general background the following publications disclose various antenna configurations at least some of which relate to stowable and deployable antenna arrays:

U.S. Pat. No. 7,372,423; U.S. Pat. No. 7,265,719; U.S. Pat. No. 7,211,722; U.S. Pat. No. 7,009,578; U.S. Pat. No. 6,906,679; U.S. Pat. No. 6,266,030; U.S. Pat. No. 5,519,408; U.S. Pat. No. 5,357,259; U.S. Pat. No. 5,313,221; U.S. Pat. No. 5,227,808; U.S. Pat. No. 5,196,857; U.S. Pat. No. 4,482,900; EP 194749; EP 833,404; WO 2008/007143; WO 2006/130993; WO 2004/015809; GB 2,444,802; "The Development of Inflatable Array Antennas" (Huang et al, American Institute of Aeronautics and Astronautics, 2002); "Performance Evaluation of a Membrane Waveguide Array Antenna" (Fralick et al; IEEE, 2003); "Tape Spring Large Deployable Antenna" (Soykasap et al, American Institute of Aeronautics and Astronautics Paper 2006-1601, 2006); "Integration of a 4×8 Antenna Array with a Reconfigurable 2-bit Phase Shifter using RF MEMS Switches on Multilayer Organic Substrates" (Chung et al, IEEE, 2007); "Design of a Deployable Antenna Actuated by Shape Memory Alloy Hinge" (Lan et al, Trans Tech Publications, 2007); "Deployable Antenna Kinematics using Tensegrity Structure Design" (B F Knight, Thesis, University of Florida, 2000).

SUMMARY OF THE INVENTION

According to a first aspect of the invention there is provided a deployable antenna array having at least one boresight axis, comprising

- a first plurality of first antenna array elements, each said first antenna array element being of general planar construction and comprising antenna radiator elements and supporting/conditioning circuitry;
- a second plurality of second antenna array elements separate from first plurality of first antenna array elements, each said second antenna array element being configured as a ground plane for, and being associated with, at least one respective said first antenna array element;
- wherein said antenna array is configured for being selectively deployable at least from a stowed configuration to a deployed configuration, wherein a relative spatial relationship between said first antenna array elements and said second antenna array elements is changed between said stowed configuration and said deployed configuration; and
- wherein said antenna radiator elements and supporting/conditioning circuitry of each said first antenna array element are configured, in operation of the antenna array with said antenna array in said deployed configuration, for at least one of radiating and receiving RF energy in a direction parallel to said at least one boresight axis in cooperation with a respective said ground plane provided by at least one respective said second antenna array element.

Optionally, according to alternative variations of the first aspect of the invention, the antenna array has one or more of the following features:

- said first antenna array elements are generally aligned with said at least one boresight axis at least in said deployed configuration;
- said second antenna array elements are pivotably connected to said first antenna array elements for enabling said antenna array to be selectively deployed at least from said stowed configuration to said deployed configuration, wherein said relative spatial relationship between said first antenna array elements and said second antenna array elements is changed between said stowed configuration and said deployed configuration by relative pivoting therebetween;
- the antenna array has an absence of electrical conductors configured for providing electrical communication between said second antenna array elements and said antenna radiator elements and supporting/conditioning circuitry.

According to a second aspect of the invention there is provided a deployable antenna array having at least one boresight axis and configured for being selectively deployable at least from a stowed configuration to a deployed configuration, comprising:

- a first plurality of first antenna array elements, each said first antenna array element being of general planar construction and comprising antenna radiator elements and supporting/conditioning circuitry, wherein said first antenna array elements are generally aligned with said at least one boresight axis at least in said deployed configuration;
- a second plurality of second antenna array elements separate from said first plurality of first antenna array elements;
- wherein said second antenna array elements are pivotably connected to said first antenna array elements for enabling said antenna array to be selectively deployed at least from said stowed configuration to said deployed configuration, wherein a relative spatial relationship between said first antenna array elements and said second antenna array elements is changed between said stowed configuration and said deployed configuration by relative pivoting therebetween;
- wherein the antenna array has an absence of electrical conductors configured for providing electrical communication between said second antenna array elements and said antenna radiator elements and supporting/conditioning circuitry.

Optionally, according to alternative variations of the second aspect of the invention, the antenna array has one or more of the following features:

- each said second antenna array element is configured as a ground plane for, and being associated with, at least one respective said first antenna array element;
- said antenna radiator elements and supporting/conditioning circuitry of each said first antenna array element are configured, in operation of the antenna array with said antenna array in said deployed configuration, for at least one of radiating and receiving RF energy in a direction parallel to said at least one boresight axis in cooperation with a respective said ground plane provided by at least one respective said second antenna array element.

Optionally, according to alternative variations of the first aspect of the invention and/or according to the second aspect of the invention, the antenna array has one or more of the following features:

said first antenna array elements are in lateral spaced adjacent relationship and configured for being generally aligned with said boresight axis at least in said deployed configuration;

each said second antenna array elements is pivotably mounted to a respective adjacent pair of said first antenna array elements and configured for pivoting with respect thereto between said stowed configuration and said deployed configuration, to provide a first spacing therebetween in said stowed configuration and a second spacing, greater than said first spacing, in said deployed configuration;

in said stowed configuration, said first array elements of each said adjacent pair are in staggered parallel relationship.

According to a third aspect of the invention there is provided a deployable antenna array having at least one boresight axis and configured for being selectively deployable at least from a stowed configuration to a deployed configuration, comprising:

a first plurality of first antenna array elements, and a second plurality of second antenna array elements separate from first plurality of first antenna array elements, wherein said first antenna array elements are in lateral spaced adjacent relationship and configured for being generally aligned with said boresight axis at least in said deployed configuration, wherein each said second antenna array elements is pivotably mounted to a respective adjacent pair of said first antenna array elements and configured for pivoting with respect thereto between said stowed configuration and said deployed configuration, to provide a first spacing therebetween in said stowed configuration and a second spacing, greater than said first spacing, in said deployed configuration; and wherein in said stowed configuration, said first array elements of each said adjacent pair are in staggered parallel relationship.

Optionally, according to alternative variations of the third aspect of the invention, the antenna array has one or more of the following features:

each said first antenna array element being of general planar construction and comprising antenna radiator elements and supporting/conditioning circuitry;

each said second antenna array element being configured as a ground plane for, and being associated with, at least one respective said first antenna array element;

a relative spatial relationship between said first antenna array elements and said second antenna array elements is changed between said stowed configuration and said deployed configuration;

said antenna radiator elements and supporting/conditioning circuitry of each said first antenna array element are configured, in operation of the antenna array with said antenna array in said deployed configuration, for at least one of radiating and receiving RF energy in a direction parallel to said at least one boresight axis in cooperation with a respective said ground plane provided by at least one respective said second antenna array element.

Optionally additionally or alternatively, according to alternative variations of the third aspect of the invention the antenna array has one or more of the following features:

each said first antenna array element is of general planar construction and comprising antenna radiator elements and supporting/conditioning circuitry, wherein said first antenna array elements are generally aligned with said at least one boresight axis at least in said deployed configuration;

a relative spatial relationship between said first antenna array elements and said second antenna array elements is changed between said stowed configuration and said deployed configuration by relative pivoting therebetween;

the antenna array has an absence of electrical conductors configured for providing electrical communication between said second antenna array elements and said antenna radiator elements and supporting/conditioning circuitry.

Additionally or alternatively, according to each one of the first aspect, or the second aspect or third aspect of the invention as defined above, optionally including alternative variations thereof, the respective deployable antenna array may comprise one or more of the following features, in any desired combination or permutation:

(a) Wherein in said deployed configuration, said first antenna array elements and said second antenna array elements are in a first said relative spatial relationship, wherein said first antenna array elements of each adjacent pair thereof are laterally spaced from one another by a first spacing and comprise a respective said second antenna array element therebetween in general non-parallel first spatial relationship therewith; and wherein in said stowed configuration said first antenna array elements and said second antenna array elements are in a second said relative spatial relationship, wherein said second spatial relationship is different from said first spatial relationship and configured for enabling said stowed configuration to be more compact than said deployed configuration.

(b) Wherein each said first antenna array element comprises a first portion comprising the respective said antenna radiator elements thereof, and wherein said first portion projects outwardly with respect to a respective second antenna array element adjacent thereto.

(c) Wherein each said second antenna array element comprises a forward facing face defining the respective said ground plane thereof, and wherein optionally said forward facing face has a metallic surface.

(d) Wherein at least one said second antenna array element is made from a metal.

(e) Wherein at least one said second antenna array element comprises at least one through hole or wherein at least a portion of at least one said second antenna array element is formed as a net structure.

(f) Wherein said first spacing is substantially equal to half the minimum operating wavelength of the antenna array.

(g) Wherein at least one said first antenna array element comprises a plurality of said antenna radiator elements, spaced from one another on the respective said first antenna array element by a third spacing, wherein said third spacing is substantially equal to half the operating wavelength of the antenna array.

(h) Wherein at least one said first antenna array element is in the form of a substantially flat plate.

(i) Wherein at least one said second antenna array element is in the form of a substantially flat plate.

(j) Wherein in said deployed configuration at least one said second antenna array element is in mechanically spatially fixed relationship inbetween two said first antenna array elements adjacent thereto.

(k) Wherein said second antenna array elements are configured having an absence of at least one of: said supporting/conditioning circuitry; said supporting/conditioning circuitry operatively connected to said antenna radiator elements of an adjacent said first antenna array element; and electronic components in electrical communication with at least one of said antenna radiator elements and supporting circuitry of an adjacent said first antenna array element.

(l) Wherein at least two adjacent said first antenna array elements are in spaced parallel relationship in said deployed configuration, and wherein a respective said second antenna array element is connected therebetween in non-parallel relationship with respect thereto in said deployed configuration.

(m) Wherein at least two adjacent said first antenna array elements are in spaced parallel relationship in said deployed configuration, and wherein a respective said second antenna array element is connected therebetween in orthogonal relationship with respect thereto in said deployed configuration.

(n) Wherein at least two adjacent said first antenna array elements are in one of spaced diverging relationship and spaced converging relationship in said deployed configuration, and wherein a respective said second antenna array element is connected therebetween in non-parallel relationship with respect thereto in said deployed configuration.

(o) Wherein said respective second antenna array element comprised between said two adjacent said first antenna array elements is in substantially similar angular relationship with respect to each one of said two adjacent said first antenna array elements.

(p) Wherein said second antenna array elements have a geometrical form that remains substantially undistorted at least during deployment of said antenna array between said stowed configuration and said deployed configuration.

(q) Wherein said second antenna array elements are configured to behave as substantially rigid bodies when said antenna array is deployed from said stowed configuration and said deployed configuration.

(r) Wherein in said second spatial relationship, said first antenna array elements of each adjacent pair thereof are laterally spaced from one another by a second spacing, wherein said second spacing is smaller than said first spacing.

(s) Wherein said first spacing is correlated with a first geometric dimension of said second antenna array elements, and wherein optionally said first spacing is correlated with said first geometric dimension of said second antenna array elements, and wherein said second spacing is correlated with a second geometric dimension of said second antenna array elements, wherein said second geometric dimension of said second antenna array elements is a width dimension.

(t) Wherein at least one said second antenna array element is pivotably mounted to two said first antenna array elements adjacent thereto, wherein said antenna array is deployed from said stowed configuration to said deployed configuration by relative pivoting of the at least one said second antenna array element with respect to the respective two said first antenna array elements adjacent thereto from said stowed configuration, wherein said at least one said second antenna array element is in substantially parallel relationship inbetween said respective two said first antenna array elements adjacent thereto, and said deployed configuration wherein said at least one said second antenna array element is in substantially non-parallel relationship inbetween said respective two said first antenna array elements adjacent thereto.

(u) Wherein at least one said second antenna array element is selectively and reversibly engageably mountable to two said first antenna array elements adjacent thereto, wherein said antenna array is deployed from said stowed configuration to said deployed configuration by engaging the at least one said second antenna array element with respect to the respective two said first antenna array elements adjacent thereto in said deployed configuration wherein said at least one said second antenna array element is in substantially non-parallel relationship inbetween said respective two said first antenna array elements adjacent thereto.

(v) Wherein said first antenna array elements are similar one to another, and wherein said second antenna array elements are similar one to another.

(w) Wherein in said stowed configuration, said antenna array occupies a compact volume that is fittable in a backpack.

Optionally, the antenna array according to the first aspect or the second aspect of the third aspect of the invention as defined above and optionally including alternative variations thereof and/or optionally comprising one or more of features (a) to (w) above in any combination or permutation, may further comprise an aft support structure comprising at least one primary support element configured for being joined to said first antenna array elements of at least one respective adjacent pair thereof in general non-parallel spatial relationship therewith in said deployed configuration. Additionally, the respective deployable antenna array may comprise one or more of the following features, in any desired combination or permutation:

(A) Wherein said at least one primary support element configured for being joined to said first antenna array elements of at least one respective adjacent pair thereof in aft spaced relationship with respect to a said second antenna array element that is also joined to the same said adjacent pair of said first antenna array elements.

(B) Wherein at least one said second antenna array element and a respective said at least one primary support element are each pivotably mounted to each of two said first antenna array elements adjacent thereto, wherein said antenna array is deployed from said stowed configuration to said deployed configuration by relative pivoting of said pivotably mounted second antenna array element and said pivotably mounted primary support element with respect to the respective two said first antenna array elements adjacent thereto from said stowed configuration, wherein said pivotably mounted second antenna array element and said pivotably mounted primary support element are each in substantially parallel relationship inbetween said respective two said first antenna array elements adjacent thereto, and said deployed configuration wherein said pivotably mounted second antenna array element and said pivotably mounted primary support element are in substantially non-parallel relationship inbetween said respective two said first antenna array elements adjacent thereto.

(C) Wherein in said deployed configuration said pivotably mounted second antenna array element and said pivotably mounted primary support element are each in substantially orthogonal relationship inbetween said respective two said first antenna array elements adjacent thereto.

(D) Wherein in said deployed configuration, at least one said second antenna array element and at least one primary support element are connected inbetween two said first antenna array elements adjacent thereto to form a parallelepiped structure, and wherein optionally said parallelepiped structure comprises a cuboid structure.

(E) Wherein the respective antenna array further comprises an auxiliary support structure comprising at least one secondary support element configured for being affixed to at least one adjacent pair of said first antenna array elements in substantially orthogonal relationship therewith in said deployed configuration.

(F) Wherein said at least one secondary support element is in substantially orthogonal relationship with respect to at least one said second antenna array element in said deployed configuration.

(G) Wherein said at least one secondary support element is pivotably mounted to a respective first antenna array element adjacent thereto and pivotably movable between a first position in said stowed configuration, wherein said pivotably mounted secondary support element is in parallel relationship with said adjacent first antenna array element, and a second position in said deployed configuration, wherein said pivotably mounted secondary support element in orthogonal relationship with said adjacent first antenna array element.

(H) Wherein in said deployed configuration, at least one said second antenna array element and at least one primary support element and at least two said secondary support element are connected to two said first antenna array elements adjacent thereto to form a closed box structure.

(I) Wherein at least one said secondary support element comprises at least one planar antenna element.

(J) Wherein at least one said second antenna array element further comprises at least one planar antenna element.

According to a fourth aspect of the invention, there is provided a radar system, comprising the antenna array as defined above for any one of the first, second or third aspects of the invention, including alternative variations thereof defined above and/or one or more of features (a) to (w) and/or (A) to (J) above, mutatis mutandis.

According to a fifth aspect of the invention, there is provided a telecommunications system, comprising the antenna array as defined above for any one of the first, second or third aspects of the invention, including alternative variations thereof defined above and/or one or more of features (a) to (w) and/or (A) to (J) above, mutatis mutandis.

According to a sixth aspect of the invention, there is provided method for deploying an antenna array, comprising providing an antenna array as defined above for any one of the first, second or third aspects of the invention, including alternative variations thereof as defined above and/or one or more of features (a) to (w) and/or (A) to (J) above, mutatis mutandis.

selectively deploying said antenna array from said stowed configuration to said deployed configuration by changing said relative spatial relationship between said first antenna array elements and said second antenna array elements.

In at least some embodiments of the invention, the antenna radiator elements and supporting circuitry are formed or affixed on the first antenna array elements, in planes substantially aligned with the main boresight axis or direction of the antenna array, thereby freeing the second antenna array elements of any such components. A feature of such a structure is that the first spacing between adjacent pairs of first antenna array elements can be freely set to correspond to any desired dimension including half of any desired minimum operating wavelength for the antenna array, while at the same time providing almost unrestricted space for accommodating the radiator elements and supporting/conditioning circuitry on the first antenna array elements in an aft direction that does not limit or interfere with the ground plane.

In at least some embodiments of the invention, the antenna radiator elements and supporting/conditioning circuitry are formed or affixed only on the first antenna array elements, and the second antenna array elements operate as ground planes therefor, but otherwise do not comprise any electrical feedlines, electronic components or electrical components at all or such feedlines, electronic components or electrical components that are in electrical communication with any electronic or electrical components of the adjacent first antenna array elements. A feature of such a structure is that no flexible electrical connections are required between the first antenna array elements and the second antenna array elements, which would otherwise be required to connect electronic components in the second array elements to electronic components in the first antenna array elements while still allowing for the change in relative dispositions between the first antenna array elements and the second antenna array elements while making the transition between the stowed configuration and the deployed configuration. Another feature of at least some embodiments of the invention is that the second array elements may be easily disconnected from the first array elements, and thus allow first antenna array elements and/or second antenna array elements to be replaced in the field in a relatively easy and quick manner. Another feature of at least some embodiments of the invention is that the ground plane may be configured with lightening holes and/or other openings which reduce weight and wind loading, while still providing the ground plane function.

In at least some embodiments of the invention, the antenna array provides the ability to deploy the antenna array in field conditions (and to collapse the antenna array back to the stowed configuration), with the supporting/conditioning circuitry remaining statically or fixedly associated with the corresponding first antenna array elements, with no need for flexible circuits or for flexible connections, particularly between the second antenna array elements and the first antenna array elements. A feature of such a structure is that the associated design of the antenna array is simplified and/or costs reduced.

In at least some embodiments of the invention, the second antenna array elements are formed as single plate elements that are hinged at the lateral sides thereof to the adjacent first antenna array elements, and pivot as rigid bodies with respect hereto, while making the transition between the stowed configuration and the deployed configuration. Features of such a structure as compared with alternative embodiments in which the respective second antenna array element is itself hinged and folds in an accordion-like manner, include one or more of the following: less hinged sections are required; the width of the antenna array in the stowed configuration is relatively thinner; the second antenna array elements have more natural rigidity In at least some embodiments of the invention, the antenna array is configured having antenna radiator elements on the first antenna array elements aligned with the respective boresight axis as opposed to providing patch antennas on ground planes. A feature of such a structure is that a relatively larger bandwidth is provided.

In at least some embodiments of the invention, the first antenna array elements are modular, and the second antenna array elements are also modular, providing substantial flexibility in terms of logistics and operation of the antenna array. Furthermore, in at least some embodiments of the invention the first antenna array elements can be manufactured following standard production methods, providing cost benefits.

In at least some embodiments of the invention, the first antenna array elements and the second antenna array elements provide the mechanical support structure for the antenna array. In at least some embodiments of the invention this support structure can be further reinforced and stiffened in a relatively simple manner, using aft plates parallel to the ground planes and/or stiffening plates orthogonal thereto.

Herein "supporting/conditioning circuitry" is meant to include at least the minimum electronic components and arrangement thereof that is required to be provided in close proximity to the respective antenna radiator element in the respective first antenna array element, for enabling the respective antenna radiator element to transmit and/or receive RF energy, when suitably connected to a power source (and to other respective electronic components of the antenna array, as appropriate, that may also be on the respective first antenna array element or remote therefrom) as is known in the art.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
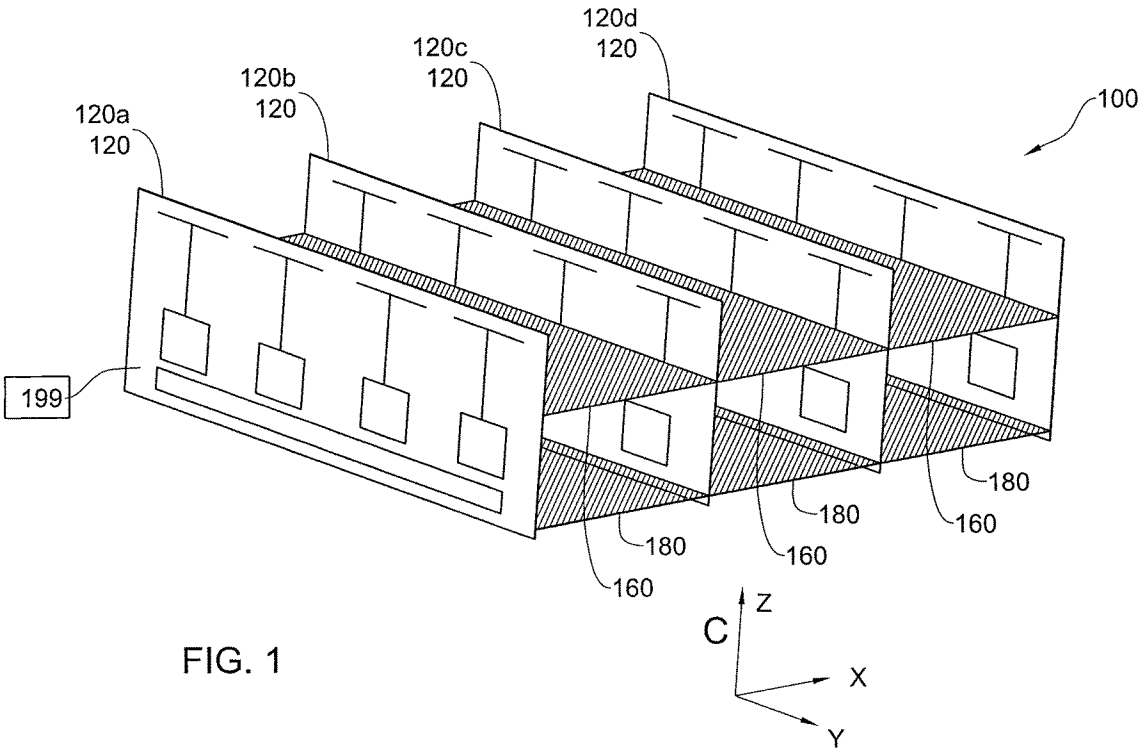
FIG. 1 is an isometric front/top/side view of an antenna array according to a first embodiment of the invention.
Figure 2B:
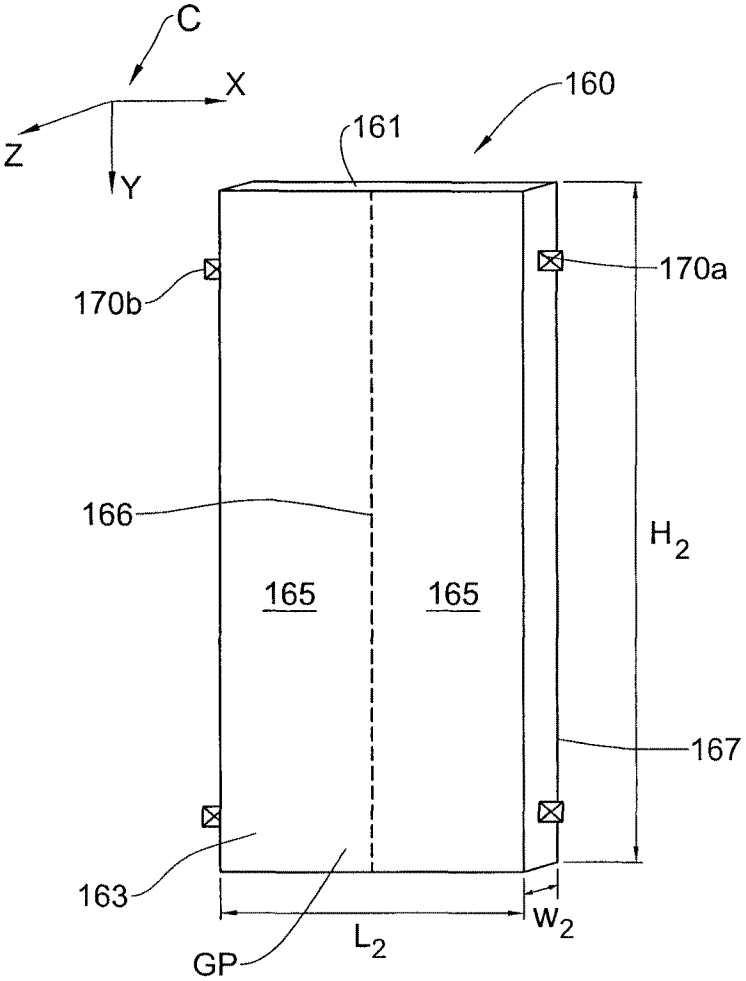
FIGS. 2(*a*) and 2(*b*) are isometric views of a first antenna array element and a second antenna array element, respectively, of the embodiment of FIG. 1.
Figure 2A:
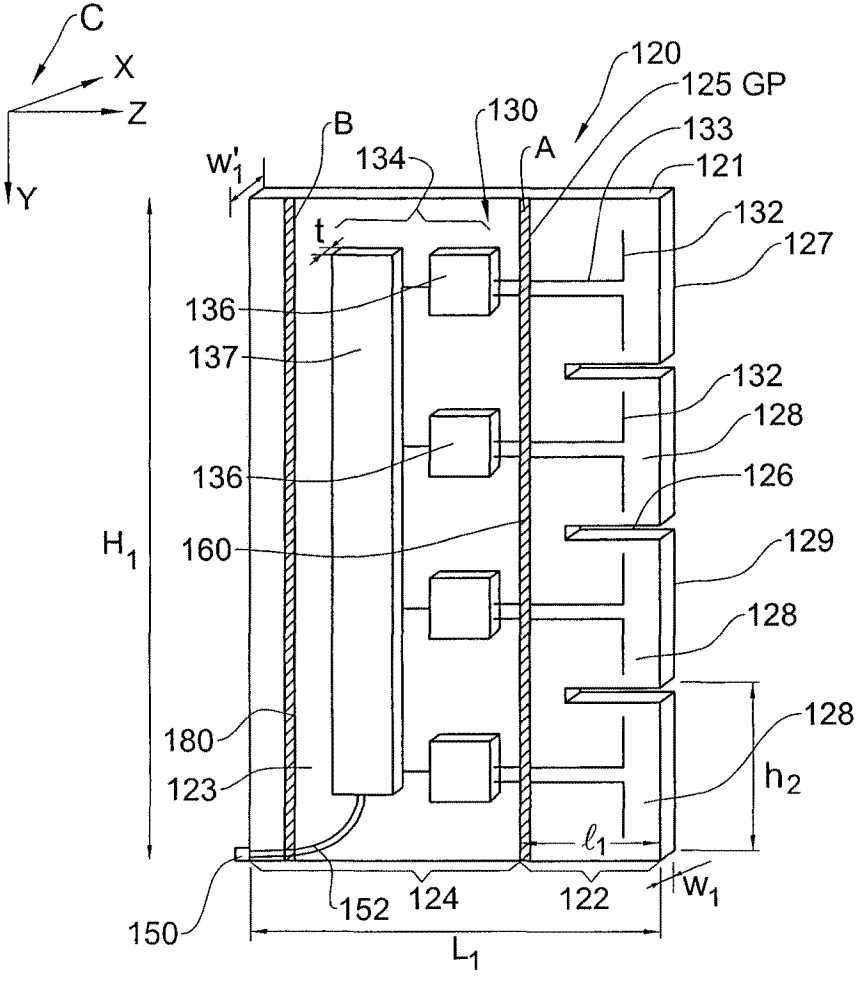

Referring to FIGS. 1, 2(*a*) and 2(*b*), an antenna array according to a first embodiment of the invention, generally designated 100, comprises a plurality of first antenna array elements 120 and a plurality of second antenna array elements 160. Each second antenna array element 160 is associated with a pair of first antenna array elements 120 adjacent thereto.

While the first embodiment includes four first antenna array elements 120 and three second antenna array elements 160, it is to be understood that the antenna array is not limited to these numbers of first and second antenna array elements, and in alternative variations of this embodiment, the respective antenna array may comprise any desired number of first antenna array elements 120 (less than four or more than four) and any corresponding number of second antenna array elements 160 (less than three or more than three), wherein the first antenna array elements 120 are in parallel, spaced disposition one to another, wherein each pair of adjacent first antenna array elements 120 is spanned by a respective second antenna array element 160, mutatis mutandis.

In particular, the antenna array 100 is configured for being deployed from a relatively compact stowed configuration to the deployed configuration illustrated in FIG. 1 in a simple manner, requiring simple manual manipulations, or the use of simple tools, as will be explained in greater detail herein.

For example, the antenna array 100, when deployed and operational, may be configured for generating one or a plurality of lobes with respect thereto, as known in the art, to enable operation thereof as a phased antenna array, enabling scanning through an angular range in azimuth as well as elevation.

While the four first antenna array elements 120 are also designated individually as 120*a*, 120*b*, 120*c* and 120*d*, respectively, for facilitating understanding of this embodiment, unless otherwise specified the reference numeral 120 will also refer to each one of the first antenna array elements.

In this embodiment the first antenna array elements 120 are substantially identical to one another, and thus may be manufactured as modular units, for example. Similarly, the second antenna array elements 160 are substantially identical to one another, and thus may also be manufactured as modular units.

For convenience, a Cartesian coordinate system C may be defined comprising three mutually orthogonal axes X, Y, Z with respect to the antenna array 100 in the deployed configuration illustrated in FIG. 1. In this embodiment, in the deployed configuration the antenna array 100 is in the form of a planar antenna, wherein the various second antenna array elements are substantially co-planar, and the antenna array has a single boresight axis, parallel to the Z-axis, wherein the boresight axis represents the physical direction of the main lobe of the antenna array 100, or the direction of maximum antenna gain of the antenna array 100.

Figure 5:
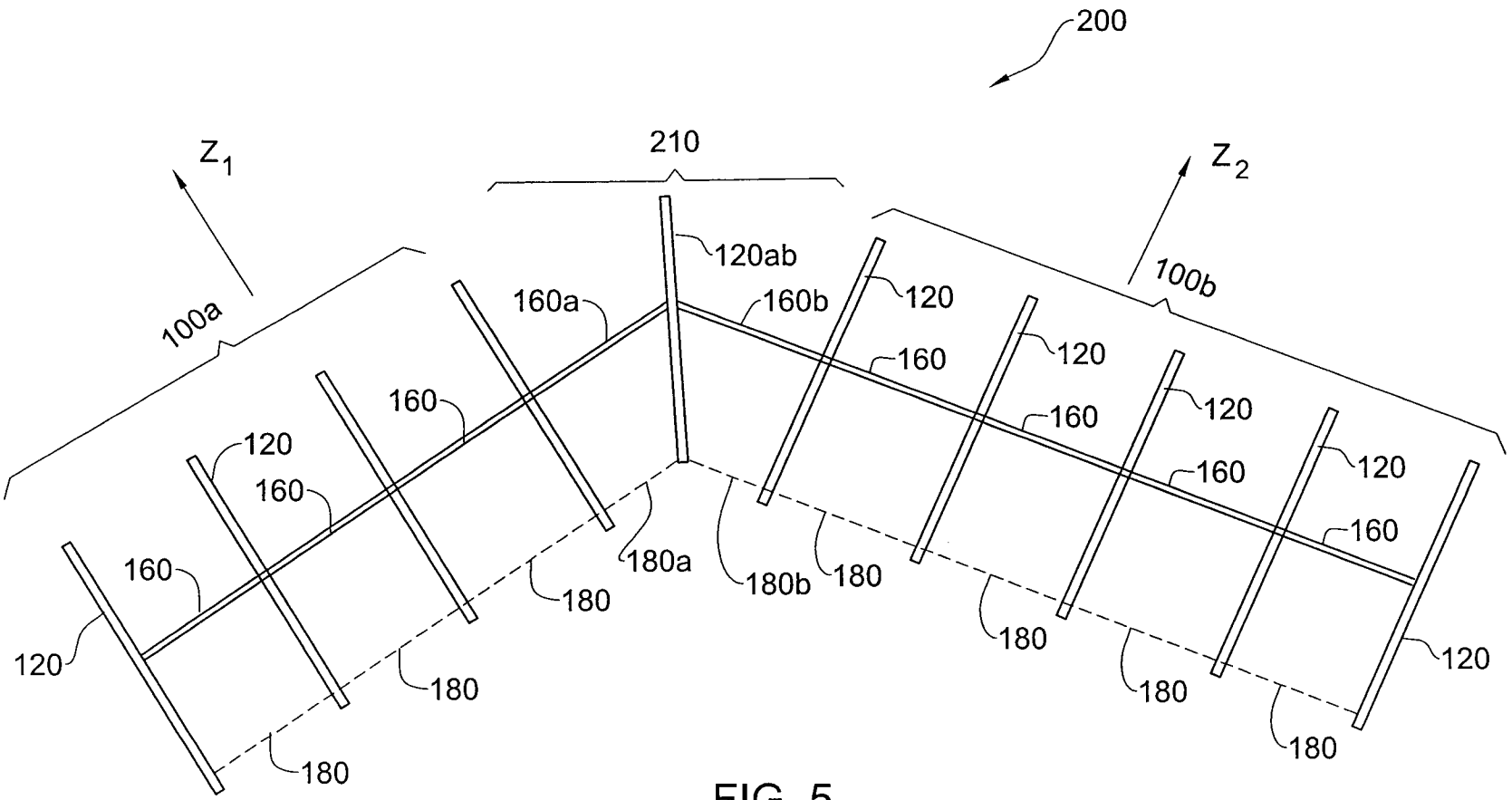
FIG. 5 shows in top view an antenna array according to a second embodiment of the invention.
Figure 6:
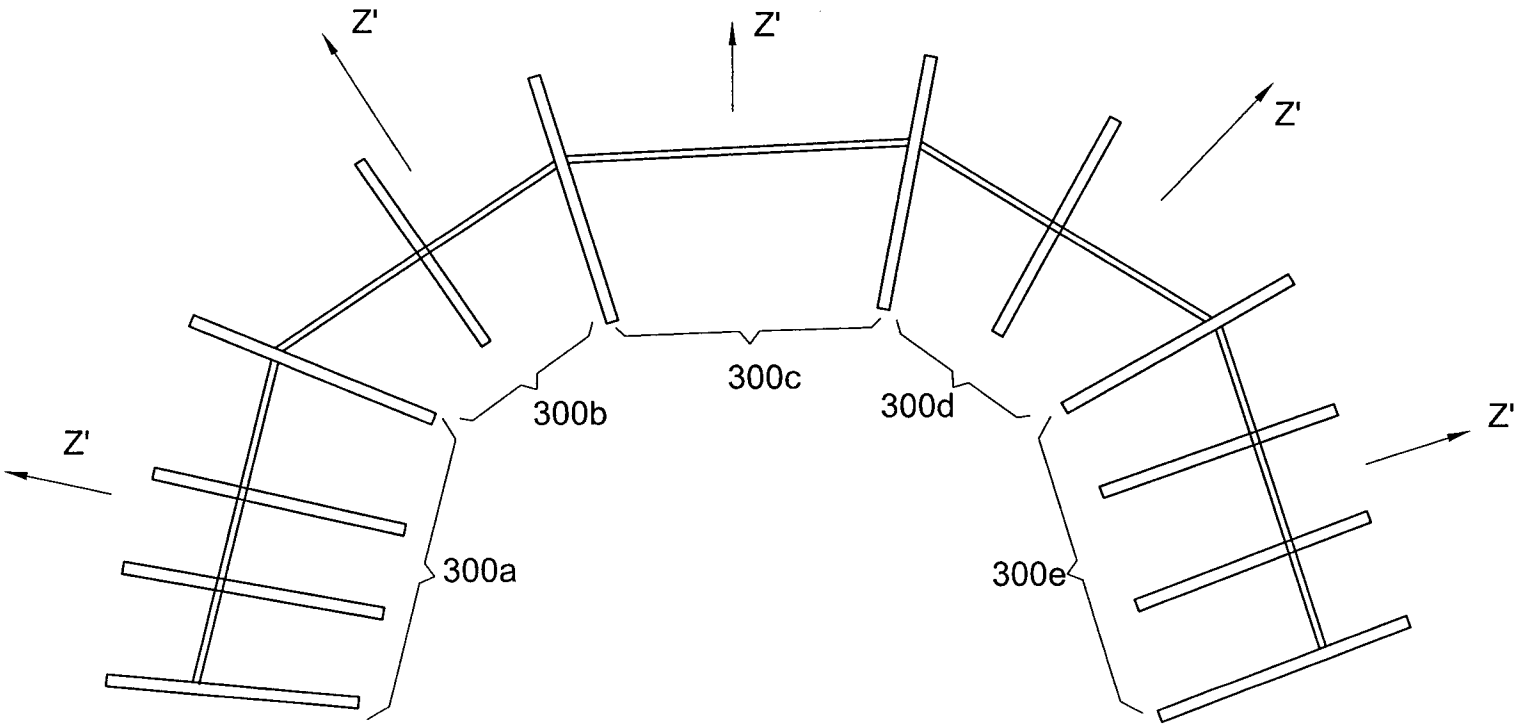
FIG. 6 shows in top view an alternative variation of the embodiment of FIG. 5.

In alternative variations of this embodiment, in which the antenna array may have a circular, semi circular or other non-planar form in the deployed configuration, in which at least two adjacent second antenna array elements are not substantially co-planar, for example as illustrated in FIGS. 5 and 6, the antenna array may be considered to have more than one boresight axis, each such boresight axis being parallel to the respective Z-axis of each individual first antenna array element, or group of adjacent first antenna array elements that are in parallel relationship to one another, and thus each such boresight axis represents the physical direction of the main lobe, or the direction of maximum antenna gain, of the respective aforesaid first antenna array element or group of parallel first antenna array elements.

Referring in particular to FIG. 2(*a*), each first antenna array element 120 has a general planar construction, being in the form of a substantially rigid rectangular plate 121 (also interchangeably referred to herein as a substantially rigid panel), having a length $L_1$ (along the Z direction), height $H_1$ (along the Y direction), and thickness or width $W_1$ (in the X direction). The plate 121 thus comprises a first generally planar face 123 spaced by the thickness $W_1$ from a second generally planar face 127, each planar face being defined by height $H_1$ and length $L_1$. In this embodiment, the height $H_1$ is greater than the length $L_1$, although in at least some alternative variations of this embodiment the height $H_1$ may be equal to or less than the length $L_1$. In any case, the width $W_1$ is much smaller than the other dimensions of the plate 121, i.e., than the height $H_1$ or length $L_1$.

Each first antenna array element 120 or plate 121 comprises a forward portion 122 (in the Z-direction) and an aft portion 124 separated by an imaginary line 125 that marks the position of the ground plane GP of the respective first antenna array elements 120 adjacent thereto, and of antenna array 100. The forward portion 122 comprises a plurality of slots 126, each extending in an aft direction (along the Z-axis) from the uppermost, free edge 129 of the plate 121 up to the line 125 or close thereto, thereby dividing the forward portion 122 into a number of (in the illustrated embodiment, four) forward projecting portions 128 (with respect to the position of the ground plane GP, or line 125), each having a height $h_1$ in the Y-direction, a length $l_1$ in the Z-direction (defined between the edge 129 and line 125), and thickness $W_1$. In alternative variations of this embodiment, the plates 121 omit slots 126, and instead the forward portion 122 may be divided into said portions 128 by means of imaginary lines corresponding to the slots 126, and thus in such embodiments such portions 128 that are adjacent in a pair thereof are laterally joined to one another.

In this embodiment, each first antenna array element 120 comprises electronic components 130, some of which are active electronic components and some of which are passive electronic components, as will be explained in greater detail below.

In this embodiment, each first antenna array element 120 is in the form of a printed circuit board (PCB), wherein the passive electronic components thereof are printed thereon (or in internal layers of the PCB, providing shielding and protection to such components), and active components are manufactured separately and mounted to the PCB, for example via surface mount technology (SMT). Other manufacturing arrangements are also possible as known in the art.

Thus, the electronic components 130 (also interchangeably referred to herein as electronic elements) of the respective first antenna array element 120 or plate 121 are arranged in a generally coplanar relationship therewith.

The electronic components 130 are configured, in operation of the antenna array, for radiating and for receiving RF energy (also referred to interchangeably herein as RF signals, or electromagnetic (EM) signals, or electromagnetic (EM) energy), in cooperation with a ground plane, although in alternative variations of this embodiment the aforesaid electronic components 130 may be configured for only radiating RF energy or for only receiving RF energy in cooperation with a ground plane.

The electronic components 130 include a plurality of antenna radiator elements 132 and supporting/conditioning circuitry 134. Each antenna radiator element 132 is provided in a respective projecting portion 128, while the supporting/conditioning circuitry 134 for the respective array element 120 is provided in the respective aft portion 124. While in this embodiment, all the radiator elements 132 and supporting/conditioning circuitry 134 of each first antenna array element 120 are provided on the first planar face 123, in alternative variations of this embodiment one or more of the radiator elements 132 and/or the supporting/conditioning circuitry 134 of at least one first antenna array element 120 may be provided on the second planar face 127 or within the respective plate 121, for example via wells.

At least some of the components of the antenna radiator element 132 and/or of the supporting/conditioning circuitry 134 may project from the first planar face 123 (and/or second planar face 127) by a maximum amount t, thereby increasing the effective width of the first antenna array elements 120 to $W_1'$.

Each antenna radiator element 132 (in conjunction with its supporting/conditioning circuitry 134) is in particular configured for operating for at least one of radiating and receiving RF energy in conjunction with a respective ground plane GP, which is provided by the respective one or two second antenna array elements 160 associated with the respective first antenna array element 120, and adjacent thereto, as will become clearer hereinbelow.

In the first embodiment, each antenna radiator element 132 comprises a printed dipole antenna and balun, and the supporting/conditioning circuitry 134 comprises a corresponding RF front end 136 and a common circuitry 137 that services all the RF front ends 136 of the respective first antenna array element 121. The RF front end 136 is configured for providing signal conditioning in either receive or transmit modes and is operatively connected to the respective antenna radiator element 132 via suitable electrical conducting paths 133. The RF front end 136 comprises suitable electronic components for providing the aforesaid signal conditioning, such as for example amplifiers, filters, modulators, demodulators, up/down converters, phase shifters, power splitter/combiners, couplers, analog to digital and/or digital to analog converters, and so on, suitably configured and interconnected.

The common circuitry 137 comprises DC power regulation units, system controllers, RF/IF combiners/splitters, RF signal sources, RF regulation circuits, data links, communication channels and so on, suitably configured and interconnected to transmit and/or receive EM signals via the RF front ends 136.

The aforesaid passive electronic components may include, for example, the antenna radiator element 132, filters, DC and control, lines and so on, while the aforesaid active electronic components may include, for example, at least part of supporting/conditioning circuitry 134, for example amplifiers, analog-digital converters, digital to analog converters, modulators, switches, and so on.

It is to be noted that in at least some alternative variations of this embodiment, some of the components of the supporting/conditioning circuitry 134 does not require to be in close proximity to the respective antenna radiator element 132, and may be provided remote from the respective first antenna array elements 120 and suitably connected to the other electronic components 130 thereof.

In the first embodiment, the supporting/conditioning circuitry 134 does not include a DC power source, but instead is operatively connected, for example via suitable electrical conducting paths 152, to a suitable interface 150 that is configured for enabling electrical connection to a suitable DC power source. In this embodiment, the interface 150 is in the form of an electrical plug or socket that is connectable to a complementary socket or plug, respectively, of a suitable DC power source (not shown) that is external to and separate from the antenna array 100.

Similarly, the electronic components of the antenna array 100 may be operatively connected to a suitable processing and control unit 199 (FIG. 1), either mounted to the antenna array 100 (to one first antenna array element, for example) or separate therefrom, for processing electromagnetic signals received and/or transmitted by the radiator elements of the antenna array 100, by suitable conductors, for example flexible cables.

In alternative variations of this embodiment, the DC power source and/or the control unit 199 may be provided on one or another of upper and lower stiffening members that may be provided, for example one or another of stiffening plates, 184, 186 respectively, which will be described in further detail below with reference to FIGS. 4(*a*) and 4(*b*) in particular.

The electronic components 130 of the antenna array 100 can be isolated from the external environment using techniques known in the art, for example suitable coatings, polymer encapsulation, and so on.

In the above or other alternative variations of the first embodiment, the aforesaid electronic components are manufactured individually, either using suitable printing techniques or in any other manner, or the aforesaid specific electronic components are replaced with other electronic components that are configured for carrying out similar functions, and mounted onto plate 121 in a configuration similar to that described above, mutatis mutandis, and in any case, the electronic components of the respective plate 121 are arranged in an essentially coplanar relationship therewith.

Referring in particular to FIG. 2(*b*) (and to the deployed configuration of the antenna array 100 of FIG. 1 with respect to the coordinate system C), each second antenna array element 160 has a general planar construction, being in the form of a substantially rigid rectangular plate 161 (also interchangeably referred to herein as a substantially rigid panel), having a length $L_2$ (along the X direction, in said deployed configuration), height $H_2$ (along the Y direction, in said deployed configuration), and thickness or width $W_2$ (in the Z direction, in said deployed configuration). The plate 161 thus comprises a first side 163 (which has a substantially planar face) spaced by the thickness $W_2$ from a second side 167, each side being defined by height $H_2$ and length $L_2$. In this embodiment, the height $H_2$ is greater than the length $L_2$, although in at least some alternative variations of this embodiment the height $H_2$ may be equal to or less than the length $L_2$. In any case, the width $W_2$ is much smaller than the other dimensions of the plate 161, i.e., than the height $H_2$ or length $L_2$.

In this embodiment, the height $H_2$ is substantially equal to the height $H_1$ of the first antenna array elements 120, though in alternative variations of this embodiment, height $H_2$ may be greater than or less than the height $H_1$.

In this embodiment, each second antenna array element 160 or plate 161, in particular the first side 163 thereof, defines, and is configured to operate as, an electromagnetic ground plane GP for enabling operation of the respective active components 130 to transmit and/or receive EM signals, and is formed as a substantially contiguous sheet of material. The plates 161 are made from an electrically conductive material, and preferably having a high strength to weight ratio, such as for example aluminum, magnesium, and carbon fiber. In alternative variations of this embodiment, the plates 161 are made from a non-conducting material having an upper layer of electrically conductive material (for example metal foil), which defines an upper face of the second antenna array element 160 and the respective ground plane GP. In these or other alternative variations of the first embodiment, the plates 161, are formed as a non-contiguous sheet of material, having a plurality of through-openings, for example formed as a mesh or net, or as a sheet comprising a plurality of lightening holes. Such alternative configurations for the second antenna array elements may provide reduced wind loading and/or reduced weight characteristics, as compared with a contiguous sheet configuration.

The first side 163 may be considered to be divided into two half-portions, 165, separated by an imaginary line 166 that is parallel to the Y-axis, though in practice these half-portions are joined to one another and are always co-planar in the first embodiment.

In the above or other alternative variations of the first embodiment, the two half-portions 165 are hingedly connected at line 166, and thus are coplanar in the deployed configuration, but in parallel superposed relationship in the stowed configuration, so that the half portions 165 swivel or pivot about line 166 when in the process of being deployed. In alternative variations of these embodiments, the second antenna array elements 160 may comprises a plurality of parallel portions (each being substantially rigid) arranged serially in juxtaposed relationship, wherein such parallel portions that are in adjacent pairs are hingedly joined to one another deploying in an accordion like manner from a substantially parallel and superposed configuration in the stowed configuration, to a coplanar configuration in the deployed configuration.

Referring again to the first embodiment, the length $L_2$ is chosen to be substantially equal to half of nominally the shortest wavelength $\lambda$ of the operating bandwidth of the antenna array (although variations are possible as known in the art), i.e.:

$$L_2=\lambda/2$$

Similarly, the height $l_1$ of each one of the portions 128 is also chosen to be substantially equal to a quarter of nominally the average wavelength $\lambda_0$ of the operating bandwidth of the antenna array (although the height $l_1$ may instead be chosen according to element optimization, as is known in the art), i.e.:

$$l_1=\lambda_0/4$$

In at least one application of the first embodiment or the above or other alternative variations thereof, the antenna array 100 is configured for operating in a bandwidth of 0.7 Gigahertz to 1 Gigahertz and thus the dimensions $l_1$ and $L_2$ are 8 cm and 15 cm, respectively. In at least one example of such an application of the first embodiment, the antenna array 100 has the following dimensions:

$L_1$=25 cm
$H_1$=60 cm
$W_1$=3.2 mm
$W_1'$=5 mm
$h_1$=15 cm
$l_1$=8 cm
$L_2$=15 cm
$H_2$=60 cm
$W_2$=2 mm

In this embodiment, the second antenna array elements 160 do not comprise, and thus have an absence of, electronic components. In particular, the second antenna array elements 160 lack any of the radiator elements 132 and/or support circuitry 134 required for radiating and/or for receiving RF energy via the first antenna array elements 120, and there is an absence of electrical conductors (also referred to interchangeably as electrical leads, electrical feedlines, and so on) that may otherwise provide electrical communication between the second array elements 160 and the electronic components 130 of the respective first antenna array elements 120 adjacent thereto.

Thus, it may be readily appreciated that at least for some embodiments of the invention, the length dimension of the respective second portion of the respective first antenna array elements may each continue in an aft direction (−Z) indefinitely without affecting the form, size or function of the ground planes of the respective second antenna array element(s) adjacent thereto, enabling the choice or design of electronic components 130 not to be limited by the dimensions of the ground plate, i.e. to λ/2 by λ/2 for each respective antenna radiator, which is substantially set by the secured minimum operating wavelength λ, of the respective antenna array.

Furthermore, for at least for some embodiments of the invention, by providing the respective electronic components in a self-contained manner on each respective first antenna array element, without electrical interconnection with other electronic components on the respective adjacent second antenna array elements, the design, construction, structure and robustness of the antenna array is enhanced and facilitates the operations of deployment to the deployed configuration, and back to the stowed configuration, without the need for otherwise complex, costly or fragile flexible electrical connections between the first antenna array elements and the second antenna array elements.

In the above or other alternative variations of the first embodiment, the second antenna array elements 160 may, in addition to functioning as the ground planes for the first antenna array elements 120, further comprise auxiliary antenna elements that together form an auxiliary planar antenna array or subarray, and may be configured for operating at different frequencies and/or polarizations with respect to the first antenna array elements 120, for example. In such embodiments, the respective antenna array may include suitable radiator elements such as for example patch elements, which are provided on the respective ground plane of the antenna array and operate in a direction substantially perpendicular to ground plane, and/or notch or Yagi elements, which may be provided at the free ends of the respective second antenna array element and operate in a direction substantially parallel to the ground plane and the respective Y-axis. Thus, these auxiliary antenna elements may be provided on the forward facing first side 163 of the second antenna array elements 160, so that they operate in the same direction (Z) as the first antenna array elements 120. Additionally or alternatively, these auxiliary antenna elements may be provided on top and bottom ends of the second antenna array elements 160 to operate in one or both directions along the Y-axis, i.e., +Y and/or −Y. It is to be noted that in such alternative variations of the first embodiment, the first side 163 of the secondary elements 160 continues to operate as a ground plane for the respective first antenna array elements 120. Furthermore, such auxiliary antenna elements are not in electrical communication with the electronic components comprised in the adjacent first antenna array elements.

Figure 3C:
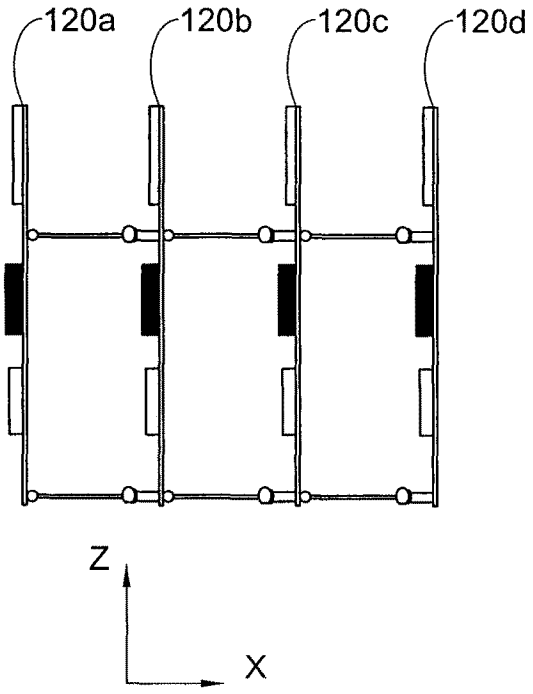
FIGS. 3(*a*), 3(*b*) and 3(*c*) are top views of the embodiment of FIG. 1 in the stowed configuration, an intermediate configuration, and the deployed configuration, respectively.
Figure 3B:
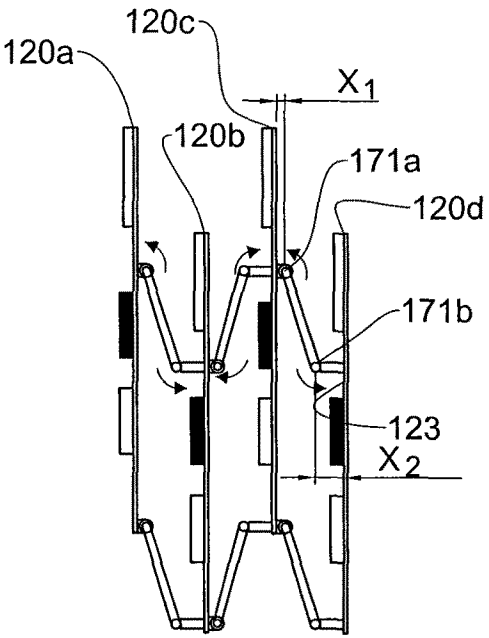
Figure 3A:
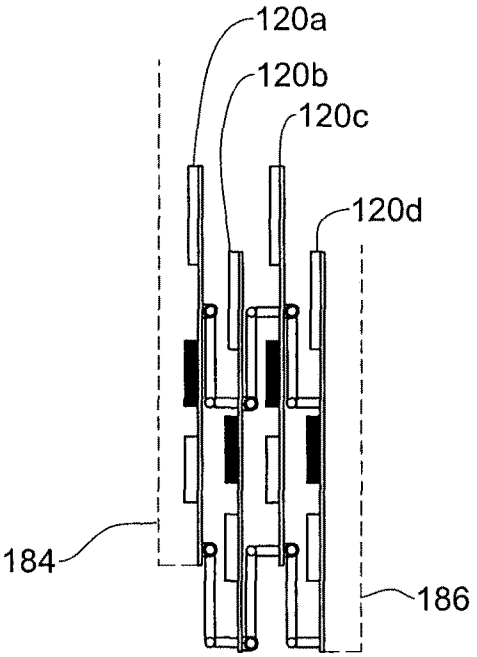

Referring also to FIGS. 3(*a*) to 3(*c*), the antenna array 100 is configured for being reversibly deployed from a compact, stowed configuration illustrated in FIG. 3(*a*) to the deployed configuration illustrated in FIG. 3(*c*) and FIG. 1, wherein in the deployed configuration the antenna array occupies a larger volume than in the stowed configuration. In alternative variations of this embodiment, the antenna array is instead only configured for being deployed from the compact, stowed configuration to the deployed configuration, but is configured to remain in the deployed configuration and cannot be readily or at all manipulated back to the stowed configuration once it has been deployed to the deployed configuration.

Thus, in the first embodiment, each of the second antenna array elements 160 is hingedly mounted to a respective pair of first antenna array elements 120 adjacent thereto via first and second hinge arrangements 170*a*, 170*b*, respectively, each of which defines a pivoting axis 171*a*, 171*b*, respectively, (also interchangeably referred to herein as respective hinge axes) parallel to the Y-axis, at position A (FIG. 2(*a*)) displaced aft from forward edge 127 of the first antenna array element 120. The first and second hinge arrangements 170*a*, 170*b* are configured and located with respect to the respective pair of adjacent first antenna array elements 120 and the respective second antenna array element 160 such that in the fully deployed configuration illustrated in FIG. 1 and FIG. 3(*c*), the second antenna array element 160 is substantially orthogonal to the pair of first antenna array elements 120 that are immediately adjacent thereto. In the stowed configuration the second antenna array elements 160 are in substantially parallel relationship to the pair of first antenna array elements 120 that are immediately adjacent thereto.

It is to be noted that in the stowed configuration the first antenna array elements 120 adopt a parallel staggered configuration, in which the forward edges 129 of adjacent first antenna array elements 120 are spaced from one another in a direction parallel the Z-axis, whereas when the second antenna array elements 160 are swiveled about the respective pivot axes 171*a*, 171*b* by about 90° to the deployed configuration the forward edges 129 are aligned and substantially coplanar. Thus, the forward edges 129 of one set of alternate first antenna array elements 120, such as for example 120*a*, 120*c* are forwardly disposed with respect to a second set of alternate first antenna array elements 120, such as for example 120*b*, 120*d*. This staggering of adjacent first antenna array elements in the stowed configuration allows a very compact structure to be formed since adjacent pairs of first antenna array elements 120 need only be spaced by the width $W_2$ of the second antenna array element 160 in the stowed configuration. To further facilitate the substantially parallel spatial orientation of each second antenna array element 160 with respect to the pair of first antenna array elements 120 adjacent thereto, the respective pivot axes 171*a*, 171*b* are spaced away from the respective planar faces 127 and 123 of the respective first antenna array elements that are facing the second antenna array element 160 by spacings x1 and x2, as best seen in FIG. 3(*b*).

To facilitate deployment of the antenna array 100, and to enhance stability and rigidity thereof in the deployed configuration, the antenna array 100 in this embodiment further comprise three aft plates 180, each aft plate 180 corresponding to and being similar in size and shape to the plates 161 (in particular the aft plate 180 having a similar length dimension to $L_2$ though optionally the height dimension thereof may be different from $H_2$) and hingedly mounted to a respective pair of adjacent first antenna array elements 120 via first and second hinge arrangements 181*a*, 181*b*, in a similar manner to the plates 161, mutatis mutandis, but displaced in an aft direction with respect to the respective plates 161, at position B (FIG. 2(*a*)). Thus, each pair of adjacent first antenna array elements 120 comprises a respective second antenna array element 160 (including respective plate 161) and a respective aft plate 180 that are hingedly mounted thereto, forming a parallelepiped-like structure which changes from a relatively shallow form illustrated in FIG. 3(*a*), corresponding to the stowed configuration of the antenna array 100, to a rectangular box or cuboid-type structure illustrated in FIG. 3(*c*), corresponding to the deployed configuration of the antenna array 100. In alternative variations of this embodiment, the aft plates 180 may have any suitable form and/or size that is suitable for providing the aforesaid stability as well as mechanical integrity.

While the first and second hinge arrangements 170*a*, 170*b* for the second antenna array elements 160, and the first and second hinge arrangements 180*a*, 180*b* for the aft plates 180, each may be configured as permanent hinge arrangements, in the first embodiment these hinge arrangements are instead configured for enabling the respective second antenna array elements 160 and aft plates 180 to be selectively disconnected with respect to the respective first antenna array elements 120 in a simple manner, for example manually without the need for tools, or by using simple tools. For example, each hinge arrangement may comprise a pair of hinge halves (one hinge half being connected to one or the other of the two respective first antenna array elements 120, and the other hinge half being connected to the respective second antenna array element 160 or to the respective aft plate 180) that mutually interconnect and are held together with a pin aligned with the respective pivot axis, allowing pivoting, wherein selective removal of the pin allows the two hinge halves to become separated. This feature facilitates the removal and replacement of one or more different components of the antenna array, for example a faulty first antenna array element 120 or second antenna array element 160, or a damaged aft plate 180, and allow the same to be replaced in an easy manner.

In the above or other alternative variations of the first embodiment, the aforesaid aft plates 180 may be replaced with suitable struts, hingedly mounted to the respective pair of first antenna array elements 120 via suitable hinge arrangements in a similar manner to the aft plates, mutatis mutandis. In yet other alternative variations of these embodiments, the aforesaid aft plates 180 may be hinged to only one of the two respective adjacent first antenna array elements 120, and reversibly or permanently engageable with the other respective first antenna array element 120 when the antenna array is in the fully deployed configuration. In yet other alternative variations of these embodiments, the aforesaid aft plates 180 may be omitted; optionally a locking mechanism may be provided for locking the first antenna array elements 120 and the respective plates 161 in orthogonal relationship in the deployed configuration, for example by means of tension wires, mechanical locks, struts, and so on.

Advantageously, a suitable mechanical stop may be provided on the second antenna array element 160 and or on the pair of adjacent first antenna array elements 120 to prevent over-rotation of the second antenna array elements with respect to their respective first antenna array elements 120.

The first antenna array elements 120 and the second antenna array elements 160 (as well as the aft plates 180) of the first embodiment (and corresponding alternative variations thereof) are each configured for behaving as separate, rigid bodies while the antenna array 100 is being deployed from the stowed configuration to the deployed configuration, simply rotating with respect to one another as separate (though mutually pivoted) substantially rigid bodies. Thus, the first antenna array elements 120 and the second antenna array elements 160 each retain their respective geometrical shapes in the stowed configuration as well as in the deployed configuration, and only their relative spatial dispositions, and particularly their relative angular dispositions, change between the stowed and deployed configurations. In the above or other alternative variations of the first embodiment, in which the second antenna array elements may comprise plates 161 each formed from two or more substantially rigid parallel portions (in which adjacent portions are hingedly joined to one another, and deploy in an accordion-like manner from a substantially parallel and superposed configuration in the stowed configuration, to a coplanar configuration in the deployed configuration), each such portion retains its respective geometrical shape in the stowed configuration as well as in the deployed configuration, and only their relative spatial dispositions, and particularly their relative angular dispositions, change between the stowed and deployed configurations.

In alternative variations of the first embodiment, the antenna array 100 may further comprise additional radiator elements, operatively connected to the supporting/conditioning circuitry 134 or to additional supporting/conditioning circuitry, but located on the second portion 124 of the respective first antenna array element 120, to provide a dual back-to-back faceted antenna array. In such a case, the aft plates 180 may to also be configured for, and function as, ground planes for these additional radiator elements.

Figure 4A:
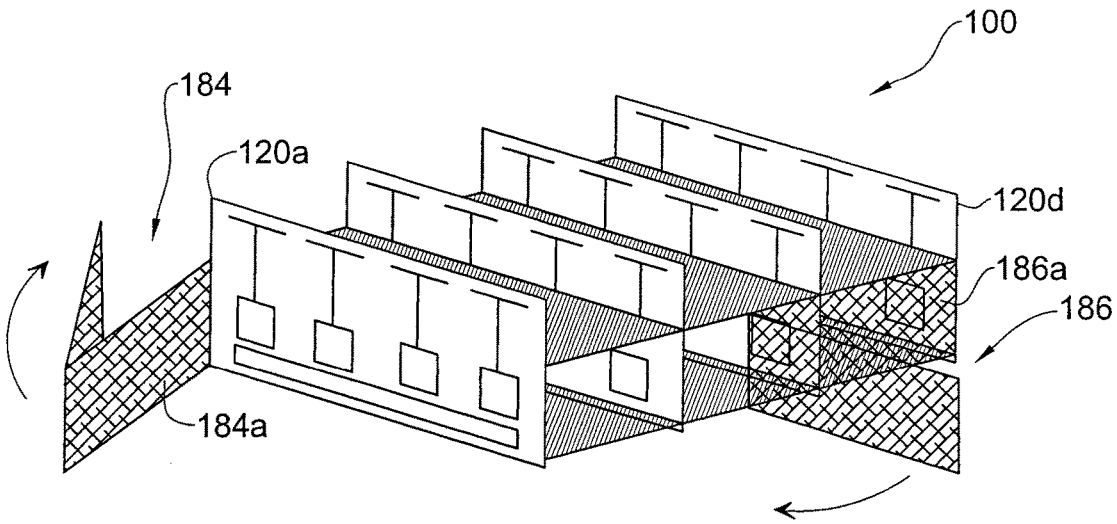
FIGS. 4(*a*) and 4(*b*) are isometric views of the embodiment of FIG. 1, further comprising auxiliary support structure partially engaged and fully engaged thereto, respectively.
Figure 4B:
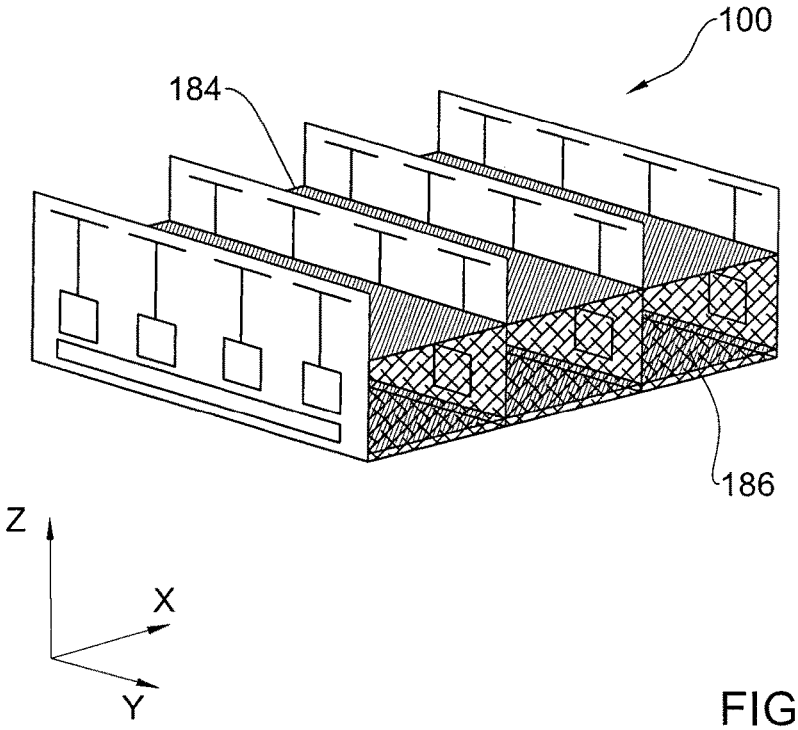

Referring to FIGS. 4(*a*) and 4(*b*), the antenna array 100 of the first embodiment (and of at least some of the above or other alternative variations of this embodiment, mutatis mutandis) further comprises upper and lower stiffening members in the form of stiffening plates, 184, 186 respectively, which in the deployed configuration illustrated in FIG. 4(*b*) are substantially orthogonal to both the first antenna array elements 120 and the second antenna array elements 160 (as well as the aft plates 180), and are engaged therewith to provide a relatively stiff, closed box-like structure. Referring to FIG. 4(*a*), each one of the upper stiffening plate 184 and the lower stiffening plate 186 comprises several adjacent panels hingedly joined together in series with respect to respective pivoting axes that are parallel to the Z-axis, wherein one such end panel (designated 184*a*, 186*a*, respectively) is hingedly mounted to a respective lateral edge 139 of the first antenna array elements 120*a*, 120*d*, respectively that are located at either end of the antenna array 100. In the stowed configuration, and until the antenna array 100 has been deployed to the deployed configuration illustrated in FIG. 3(*c*), the upper stiffening plate 184 and the lower stiffening plate 186 are in substantial parallel relationship with respect to first antenna array elements 120*a*, 120*d*, as illustrated in FIG. 3(*a*). Thereafter the various panels of the upper stiffening plate 184 and the lower stiffening plate 186 may be swiveled about their respective pivot axes as illustrated in FIG. 4(*a*) until they assume their final positions illustrated in FIG. 4(*b*).

In alternative variations of this embodiment, one or both of the upper stiffening plate 184 and the lower stiffening plate 186 may be configured to include additional planar antenna arrays, radiating and/or receiving RF energy with respect to hemispherical volumes defined above and below, respectively, of the antenna array 100. Alternatively, one or both of the upper stiffening plate 184 and the lower stiffening plate 186 may be configured to include single dimension arrays of end-fire elements, each configured for radiating and/or receiving RF energy along predetermined directions to provide corresponding omni-directional coverage for the antenna array, i.e., providing coverage in 360 degrees in azimuth.

In alternative variations of this embodiment, one or both of the upper stiffening plate 184 and the lower stiffening plate 186 may be replaced with struts or tension wires, diagonally disposed with respect to the first antenna array elements 120 and the second antenna array elements, or indeed any other mechanical arrangement that provides additional stiffness and mechanical integrity to the antenna array.

In yet other alternative variations of the first embodiment, the antenna array 100 omits the upper stiffening plate 184 and/or the lower stiffening plate 186.

In yet other alternative variations of the first embodiment, the antenna array 100 omits the aft plates 180, and the upper stiffening plate 184 and/or the lower stiffening plate 186 provide mechanical stability and integrity to the antenna array.

In yet other alternative variations of this embodiment, the components of the antenna array, including the second antenna array elements 160 (and optionally the aft plates 180 and optionally the upper stiffening plate 184 and/or the lower stiffening plate 186, or alternative variations of these components) are not hingedly mounted with respect to the first antenna array elements 120, and instead are configured, together with the first antenna array elements 120, for being assembled into the deployed configuration from a stowed configuration, in which in the stowed configuration these components of the antenna array are not connected to one another, but may be stored in compact parallel and generally superposed relationship. These components of the antenna array may be further configured for enabling quick connection (and optionally quick disconnection), for example via snap connectors or the like, to easy assembly (and optionally disassembly) of the antenna array into the deployed configuration.

The antenna array 100 according to the first embodiment and to at least some of the above and/or other alternative variations thereof is configured as a phased array antenna, and forms part of a RADAR system for identifying and/or tracking objects. Alternatively, the antenna array 100 according to the first embodiment and to at least some of the above and/or other alternative variations thereof may be configured for telecommunications and forms part of a telecommunications system, configured, for example, for receiving and/or transmitting telemetry, data, command signals and so on.

In at least one application of the first embodiment, the antenna array 100 is configured for field use, and in particular for being transported, deployed and operated by a foot solder or other operative. Accordingly, the dimensions of the antenna array 100 in the stowed configuration are such as to enable the antenna array 100 in the stowed configuration to be packed in a carrier such as back-pack or other similar carry bag or suitable container. For example, in the stowed configuration, the antenna array can fit in a cuboid volume of 40 cm (Z-direction)×60 cm (Y-direction)×15 cm (X-direction) (the antenna array comprising sixteen first antenna array elements 120 intercalated with fifteen second antenna array elements 160), and in the deployed configuration, the antenna array occupies a cuboid volume of 25 cm (Z-direction)×60 cm (Y-direction)×225 cm (X-direction). When needed, the antenna array 100 can be removed from the carrier and then deployed configuration as disclosed above. The antenna array 100 can then be connected to a suitable DC power supply and controller 199 to enable operation thereof, for example as a radio antenna or as a RADAR antenna. The antenna array 100 may be operated in a static location, for example set in place on a fixed structure or the ground, or alternatively may me mounted onto a vehicle, including for example a land vehicle or a sea faring vehicle.

Optionally, the deployed antenna array 100 may be configured for remote operation, and once it has been deployed to the deployed configuration and a suitable DC power supply and controller 199 may be controlled remotely from a different location. For example the antenna array 100 is configured for operating as a RADAR, and controller 199 comprises a telecommunications module for receiving command signals from a control center and for transmitting data (obtained from operating the radar system) thereto or to another location.

It is to be noted that in the first embodiment and in at least some of the above and other alternative variations thereof, the first antenna array elements 120 and the second antenna array elements 160 (and in corresponding embodiments, also the aft plates 180 and/or the upper stiffening plate 184 and/or the lower stiffening plate 186, or alternative variations of these components, as appropriate) are not in a pre-stressed condition in the stowed configuration, and thus the antenna array may be deployed in an easy and controlled manner by the user. In other alternative variations of these embodiments, the first antenna array elements 120 and the second antenna array elements 160 (and optionally the aft plates 180 and/or the upper stiffening plate 184 and/or the lower stiffening plate 186, or alternative variations of these components) may be pre-stressed in the stowed configuration, whereby deploying the antenna array releases part or all of the preloaded stress.

In the first embodiment and in at least some of the above and other alternative variations thereof, the antenna array 100 may be joined to or otherwise linked to one or more other antenna arrays to form a larger antenna array, for example by joining together the end first antenna array element 120*a* of one antenna array with the opposed end first antenna array element 120*d* of another antenna array.

Referring to FIG. 5, a second embodiment of the antenna array, designated with the reference numeral 200, comprises all the elements, component and features of the first embodiment and alternative variations thereof, with the following differences.

The antenna array 200 is particularly configured for operating along two different boresight axes or directions, Z1 and Z2, instead of the single boresight axis or direction Z of the first embodiment, mutatis mutandis, and thus for ease of reference the antenna array 200 may be considered as being formed from two antenna array modules, 100*a* and 100*b*, each having its main beam direction along Z1 and Z2, respectively. Each antenna array module 100*a*, 100*b* is similar to the antenna array 100 of the first embodiment, mutatis mutandis, and comprises a plurality of first antenna array elements 120, second antenna elements 160, optionally aft plates 180, and so on as already described above for the first embodiment and alternative variations thereof, mutatis mutandis.

In addition, the antenna array modules 100*a*, 100*b* are laterally joined to one another via a connection module 210, comprising another first antenna array element designated 120*ab*, and adjacent thereto a pair of second antenna array elements 160*a*, 160*b*, and a pair of aft plates 180*a*, 180*b*. In this embodiment, the first antenna array element 120*ab* is substantially identical to the other first antenna array elements 120, and the second antenna array elements 160*a*,

160*b* are substantially identical to the other second antenna array element 160 of the antenna arrays 100*a*, 100*b*, mutatis mutandis. However, while similar in many respects to the aft plates 180 of the antenna array modules 100*a*, 100*b*, the aft plates 180*a*, 180*b*, are shorter in length thereto (and to the respective second antenna array elements 160*a*, 160*b*), so that the first antenna array element 120*ab* is in diverging relationship with respect to its adjacent first antenna array elements 120 of each one of the antenna array modules 100*a*, 100*b*. While in this embodiment the second antenna array elements 160*a*, 160*b* are hingedly mounted to the first antenna array element 120*ab* and to the other first antenna array elements 120 of the antenna array modules 100*a*, 100*b* adjacent thereto, the pair of aft plates 180*a*, 180*b* are only hingedly mounted to the first antenna array element 120*ab* or to the other first antenna array elements 120 of the antenna array modules 100*a*, 100*b* adjacent thereto, and engage with the other one of the mounted to the first antenna array element 120*ab* and to the first antenna array elements 120 in the deployed configuration illustrated in FIG. 5. It is thus evident that the first antenna array element 120*ab* may be considered to be part of the antenna array module 100*a* (together with second antenna array element 160*a* and aft plate 180*a*), and/or part of the antenna array module 100*b* (together with second antenna array element 160*b* and aft plate 180*b*).

Operation of the second embodiment, and deployment from the stowed configuration to the deployed configuration, and vice versa, is similar to that described for the first embodiment and alternative variations thereof, mutatis mutandis.

It is evident that in alternative variations of the second embodiment, the antenna array may be configured for providing more than two different boresight axes or directions, and is divided into a corresponding plurality of antenna array modules, each of which is similar to the antenna array modules 100*a*, 100*b*, though each antenna array module may comprise any desired number of said first antenna array elements, each pair being spaced by a corresponding second antenna array element 160, in a similar manner to that described above for the antenna array modules 100*a*, 100*b*, mutatis mutandis. For example, as illustrated in FIG. 6, one such alternative variation of the second embodiment may comprise five antenna array modules 300*a*, 300*b*, 300*c*, 300*d*, 300*e*, each of which is similar to the antenna array modules 100*a*, 100*b*, but each comprise different numbers of first antenna array elements 120, second antenna array elements 160, and aft plates 180. Furthermore, each antenna array modules 300*a*, 300*b*, 300*c*, 300*d*, 300*e* has its respective boresight axis or direction angularly displaced with respect to that of its adjacent antenna array module. Optionally, each antenna array modules 300*a*, 300*b*, 300*c*, 300*d*, 300*e* may have a different operating wavelength, and thus the second antenna array elements 160 of each one of the antenna array modules 300*a*, 300*b*, 300*c*, 300*d*, 300*e* may have a corresponding, different length dimension $L_2$ to that of the second antenna array elements 160 of the other antenna array modules.

In one example, the antenna array of the embodiment of FIG. 6 may be partially circular or fully circular, providing a corresponding partial or full azimuth coverage.

It is also to be noted that in alternative variations of the first embodiment, mutatis mutandis, the planar antenna array 100 can be transformed to a multifaceted or circular antenna array by replacing the support plates 180 with other support plates having a different length; alternatively, the plates 180 may have several hinge arrangements which allow it to be connected to the respective adjacent first antenna array elements at effectively different lengths thereof. This allows different deployed antenna array configurations to be adopted in the field with relative ease.

Operation of the these alternative variations of the second embodiment, including deployment from the stowed configuration to the deployed configuration, and vice versa, is similar to that described for the first embodiment and alternative variations thereof, mutatis mutandis.

In the method claims that follow, alphanumeric characters and Roman numerals used to designate claim steps are provided for convenience only and do not imply any particular order of performing the steps.

Finally, it should be noted that the word "comprising" as used throughout the appended claims is to be interpreted to mean "including but not limited to".

While there has been shown and disclosed example embodiments in accordance with the invention, it will be appreciated that many changes may be made therein without departing from the spirit of the invention.

The invention claimed is:

1. A deployable antenna array having at least one boresight axis, comprising:

a first plurality of first antenna array elements, each said first antenna array element comprising antenna radiator elements and supporting/conditioning circuitry;

a second plurality of second antenna array elements separate from first plurality of first antenna array elements, each said second antenna array element being configured as a ground plane for, and being associated with, at least one respective said first antenna array element, said second antenna array elements being devoid of any electrical feedlines, electronic components, or electrical components that are in electrical communication with any electronic or electrical components of adjacent first antenna array elements;

wherein said antenna array is configured for being selectively deployable at least from a stowed configuration to a deployed configuration, wherein a relative spatial relationship between said first antenna array elements and said second antenna array elements is changed between said stowed configuration and said deployed configuration;

wherein said antenna radiator elements and supporting/conditioning circuitry of each said first antenna array element are configured, in operation of the antenna array with said antenna array in said deployed configuration, for at least one of radiating and receiving RF energy in a direction parallel to said at least one boresight axis in cooperation with a respective said ground plane provided by at least one respective said second antenna array element;

each said first antenna array element being of general planar construction in the form of a substantially rigid first panel, and each said second antenna array element being of general planar construction in the form of a substantially rigid second panel; and each said panel pivotably mounted to a respective adjacent pair of said first panels, each said second panel having a first lateral end pivotably mounted to one said first panel of said respective adjacent pair of said first panels, and a second lateral end pivotably mounted to the other said first panel of said respective adjacent pair of said first panels.

2. The antenna array according to claim 1, wherein:

said first antenna array elements are generally aligned with said at least one boresight axis at least in said deployed configuration;

said second antenna array elements are pivotably connected to said first antenna array elements for enabling said antenna array to be selectively deployed at least from said stowed configuration to said deployed configuration, wherein said relative spatial relationship between said first antenna array elements and said second antenna array elements is changed between said stowed configuration and said deployed configuration by relative pivoting therebetween; and the antenna array has an absence of electrical conductors configured for providing electrical communication between said second antenna array elements and said antenna radiator elements and supporting/conditioning circuitry.

3. The antenna array according to claim 1, wherein:

said first antenna array elements are in lateral spaced adjacent relationship and configured for being generally aligned with said boresight axis at least in said deployed configuration;

each said second antenna array element configured for pivoting with respect to the respective adjacent pair of said first antenna array elements between said stowed configuration and said deployed configuration, to provide a first spacing therebetween in said stowed configuration and a second spacing, greater than said first spacing, in said deployed configuration; and in said stowed configuration, said first array elements of each said adjacent pair are in staggered parallel relationship.

4. A deployable antenna array having at least one boresight axis and configured for being selectively deployable at least from a stowed configuration to a deployed configuration, comprising:

a first plurality of first antenna array elements, each said first antenna array element supporting/conditioning circuitry, wherein said first antenna array elements are generally aligned with said at least one boresight axis at least in said deployed configuration;

a second plurality of second antenna array elements separate from said first plurality of first antenna array elements;

each said first antenna array element being of general planar construction in the form of a substantially rigid first panel, and each said second antenna array element being of general planar construction in the form of a substantially rigid second panel;

wherein said second antenna array elements are pivotably connected to said first antenna array elements for enabling said antenna array to be selectively deployed at least from said stowed configuration to said deployed configuration, wherein a relative spatial relationship between said first antenna array elements and said second antenna array elements is changed between said stowed configuration and said deployed configuration by relative pivoting therebetween;

each said second antenna array element being pivotably connected to a respective adjacent pair of said first antenna array elements, each said second antenna array element having a first lateral end pivotably mounted to one said first antenna array element of said respective adjacent pair of said first antenna array elements, and a second lateral end pivotably mounted to the other said first antenna array element of said respective adjacent pair of said first antenna array elements;

wherein said second plurality of second antenna array elements serving as ground planes for the first plurality of first antenna array elements, said second antenna array elements excluding being devoid of any electrical feedlines, electronic components, or electrical components that are in electrical communication with any electronic or electrical components of the first antenna array elements.

5. A deployable antenna array having at least one boresight axis and configured for being selectively deployable at least from a stowed configuration to a deployed configuration, comprising:

a first plurality of first antenna array elements, and a second plurality of second antenna array elements separate from first plurality of first antenna array elements, wherein said first antenna array elements are in lateral spaced adjacent relationship and configured for being generally aligned with said boresight axis at least in said deployed configuration, each said first antenna array element being of general planar construction in the form of a substantially rigid first panel, and each said second antenna array element being of general planar construction in the form of a substantially rigid second panel;

wherein each said second antenna array element is pivotably mounted to a respective adjacent pair of said first antenna array elements, each said second antenna array element having a first lateral end pivotably mounted to one said first antenna array element of said respective adjacent pair of said first antenna array elements, and a second lateral end pivotably mounted to the other said first antenna array element of said respective adjacent pair of said first antenna array elements;

and each said second antenna array elements being configured for pivoting with respect to the respective adjacent pair of said first antenna array elements between said stowed configuration and said deployed configuration, to provide a first spacing therebetween in said stowed configuration and a second spacing, greater than said first spacing, in said deployed configuration;

wherein said second plurality of second antenna array elements serve as ground planes for the first plurality of first antenna array elements, said second antenna array elements being devoid of any electrical feedlines, electronic components, or electrical components that are in electrical communication with any electronic or electrical components of the first antenna array elements; and wherein in said stowed configuration, said first array elements of each said adjacent pair are in staggered parallel relationship.

6. The antenna array according to claim 1, wherein:

in said deployed configuration, said first antenna array elements and said second antenna array elements are in a first said relative spatial relationship, wherein said first antenna array elements of each adjacent pair thereof are laterally spaced from one another by a first spacing and comprise a respective said second antenna array element therebetween in general non-parallel first spatial relationship therewith; and wherein in said stowed configuration said first antenna array elements and said second antenna array elements are in a second said relative spatial relationship, wherein said second spatial relationship is different from said first spatial relationship and configured for enabling said stowed configuration to be more compact than said deployed configuration.

7. The antenna array according to claim 1, wherein each said first antenna array element comprises a first portion comprising the respective said antenna radiator elements thereof, and wherein said first portion projects outwardly with respect to a respective second antenna array element adjacent thereto.

8. The antenna array according to claim 1, wherein each said second antenna array element comprises a forward facing face defining the respective said ground plane thereof and having a metallic surface, or wherein at least one said second antenna array element is made from a metal.

9. The antenna array according to claim 1, wherein at least one said second antenna array element comprises at least one through hole or wherein at least a portion of at least one said second antenna array element is formed as a net structure.

10. The antenna array according to claim 1, wherein said first spacing is substantially equal to half the minimum operating wavelength of the antenna array.

11. The antenna array according to claim 1, wherein at least one said first antenna array element comprises a plurality of said antenna radiator elements, spaced from one another on the respective said first antenna array element by a third spacing, wherein said third spacing is equal to about half the operating wavelength of the antenna array.

12. The antenna array according to claim 1, wherein at least one said first antenna array element is in the form of a substantially flat plate.

13. The antenna array according to claim 1, wherein at least one said second antenna array element is in the form of a substantially flat plate.

14. The antenna array according to claim 1, wherein in said deployed configuration at least one said second antenna array element is in mechanically spatially fixed relationship in between two said first antenna array elements adjacent thereto.

15. The antenna array according to claim 1, wherein:

said second antenna array elements are configured having an absence of at least one of said supporting/conditioning circuitry;

said supporting/conditioning circuitry operatively connected to said antenna radiator elements of an adjacent said first antenna array element;

electronic components in electrical communication with at least one of said antenna radiator elements and supporting circuitry of an adjacent said first antenna array element.

16. The antenna array according to claim 1, wherein at least two adjacent said first antenna array elements are in spaced parallel relationship in said deployed configuration, and wherein a respective said second antenna array element is connected therebetween in non-parallel relationship with respect thereto in said deployed configuration.

17. The antenna array according to claim 1, wherein at least two adjacent said first antenna array elements are in spaced parallel relationship in said deployed configuration, and wherein a respective said second antenna array element is connected therebetween in orthogonal relationship with respect thereto in said deployed configuration.

18. The antenna array according to claim 1, wherein at least two adjacent said first antenna array elements are in one of spaced diverging relationship and spaced converging relationship in said deployed configuration, and wherein a respective said second antenna array element is connected therebetween in non-parallel relationship with respect thereto in said deployed configuration.

19. The antenna array according to claim 1, wherein said second antenna array elements have a geometrical form that remains substantially undistorted at least during deployment of said antenna array between said stowed configuration and said deployed configuration.

20. The antenna array according to claim 1, wherein said second antenna array elements are configured to behave as substantially rigid bodies when said antenna array is deployed from said stowed configuration and said deployed configuration.

21. The antenna array according to claim 1 wherein in said second spatial relationship, said first antenna array elements of each adjacent pair thereof are laterally spaced from one another by a second spacing, wherein said second spacing is smaller than said first spacing.

22. The antenna array according to claim 1, wherein said first spacing is correlated with a first geometric dimension of said second antenna array elements, and wherein optionally said first spacing is correlated with said first geometric dimension of said second antenna array elements, and wherein said second spacing is correlated with a second geometric dimension of said second antenna array elements, wherein said second geometric dimension of said second antenna array elements is a width dimension.

23. The antenna array according to claim 1, wherein at least one said second antenna array element is pivotably mounted to two said first antenna array elements adjacent thereto, wherein said antenna array is deployed from said stowed configuration to said deployed configuration by relative pivoting of the at least one said second antenna array element with respect to the respective two said first antenna array elements adjacent thereto from said stowed configuration, wherein said at least one said second antenna array element is in substantially parallel relationship in between said respective two said first antenna array elements adjacent thereto, and said deployed configuration wherein said at least one said second antenna array element is in substantially non-parallel relationship in between said respective two said first antenna array elements adjacent thereto.

24. The antenna array according to claim 1, wherein at least one said second antenna array element is engageably mountable to two said first antenna array elements adjacent thereto, wherein said antenna array is deployed from said stowed configuration to said deployed configuration by engaging the at least one said second antenna array element with respect to the respective two said first antenna array elements adjacent thereto in said deployed configuration wherein said at least one said second antenna array element is in substantially non-parallel relationship in between said respective two said first antenna array elements adjacent thereto.

25. A radar system, comprising the antenna array as defined in claim 1.

26. A telecommunications system, comprising the antenna array as defined in claim 1.

27. Method for deploying an antenna array, comprising providing an antenna array as defined in claim 1;

selectively deploying said antenna array from said stowed configuration to said deployed configuration by changing said relative spatial relationship between said first antenna array elements and said second antenna array elements.

28. The antenna array according to claim 1, wherein each said second antenna array element is pivotably mounted to a respective adjacent pair of said first antenna array elements about respective pivoting axes which are non-parallel with respect to said boresight axis.

29. The antenna array according to claim 1, wherein each said second antenna array element is pivotably mounted to a respective adjacent pair of said first antenna array elements about respective pivoting axes, wherein said pivoting axes are orthogonal with respect to said boresight axis.

30. The antenna array according to claim 1, further comprising an aft support structure comprising at least one primary support element configured for being joined to said first antenna array elements of at least one respective adjacent pair thereof in general non-parallel spatial relationship therewith in said deployed configuration.

31. The antenna array according to claim 30, wherein said at least one primary support element configured for being joined to said first antenna array elements of at least one respective adjacent pair thereof in aft spaced relationship with respect to a said second antenna array element that is also joined to the same said adjacent pair of said first antenna array elements.

32. The antenna array according to claim 30 wherein at least one said second antenna array element and a respective said at least one primary support element are each pivotably mounted to each of two said first antenna array elements adjacent thereto, wherein said antenna array is deployed from said stowed configuration to said deployed configuration by relative pivoting of said pivotably mounted second antenna array element and said pivotably mounted primary support element with respect to the respective two said first antenna array elements adjacent thereto from said stowed configuration, wherein said pivotably mounted second antenna array element and said pivotably mounted primary support element are each in substantially parallel relationship in between said respective two said first antenna array elements adjacent thereto, and said deployed configuration wherein said pivotably mounted second antenna array element and said pivotably mounted primary support element are in substantially non-parallel relationship in between said respective two said first antenna array elements adjacent thereto.

33. The antenna array according to claim 32, wherein in said deployed configuration said pivotably mounted second antenna array element and said pivotably mounted primary support element are each in substantially orthogonal relationship in between said respective two said first antenna array elements adjacent thereto.

34. The antenna array according to claim 30, wherein in said deployed configuration, at least one said second antenna array element and at least one primary support element are connected in between two said first antenna array elements adjacent thereto to form a parallelepiped structure, and wherein optionally said parallelepiped structure comprises a cuboid structure.

35. The antenna array according to claim 30, further comprising an auxiliary support structure comprising at least one secondary support element configured for being affixed to at least one adjacent pair of said first antenna array elements in substantially orthogonal relationship therewith in said deployed configuration.

36. The antenna array according to claim 35, wherein said at least one secondary support element is in substantially orthogonal relationship with respect to at least one said second antenna array element in said deployed configuration.

37. The antenna array according to claim 35, wherein said at least one secondary support element is pivotably mounted to a respective first antenna array element adjacent thereto and pivotably movable between a first position in said stowed configuration, wherein said pivotably mounted secondary support element is in parallel relationship with said adjacent first antenna array element, and a second position in said deployed configuration, wherein said pivotably mounted secondary support element in orthogonal relationship with said adjacent first antenna array element.

38. The antenna array according to claim 35, wherein in said deployed configuration, at least one said second antenna array element and at least one primary support element and at least two said secondary support element are connected to two said first antenna array elements adjacent thereto to form a closed box structure.

39. The antenna array according to claim 35, wherein at least one said secondary support element comprises at least one planar antenna element.

* * * * *